US008478175B2

(12) United States Patent
Murai et al.

(10) Patent No.: US 8,478,175 B2
(45) Date of Patent: Jul. 2, 2013

(54) IMAGE FORMING APPARATUS

(75) Inventors: Hiroyuki Murai, Osaka (JP); Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 201 days.

(21) Appl. No.: 13/182,555

(22) Filed: Jul. 14, 2011

(65) Prior Publication Data

US 2012/0027461 A1 Feb. 2, 2012

(30) Foreign Application Priority Data

Jul. 30, 2010 (JP) ..... 2010-171780

(51) Int. Cl.
*G03G 15/08* (2006.01)

(52) U.S. Cl.
USPC ..... 399/313; 399/303; 399/126; 198/810.02

(58) Field of Classification Search
USPC ..... 399/126, 303, 312, 313, 165; 198/810.03
See application file for complete search history.

(56) References Cited

U.S. PATENT DOCUMENTS

| | | | | |
|---|---|---|---|---|
| 6,104,899 | A * | 8/2000 | Hokari et al. | 399/165 |
| 7,860,440 | B2 * | 12/2010 | Miyata et al. | 399/329 |
| 7,941,082 | B2 * | 5/2011 | Kosako et al. | 399/301 |
| 8,351,829 | B2 * | 1/2013 | Boness et al. | 399/299 |
| 8,351,830 | B2 * | 1/2013 | Kudo et al. | 399/302 |
| 2011/0200343 | A1 * | 8/2011 | Matsumoto et al. | 399/31 |

FOREIGN PATENT DOCUMENTS

| | | |
|---|---|---|
| JP | 04-050992 | 2/1981 |
| JP | 11-020973 | 1/1999 |
| JP | 2005-138986 | 6/2005 |
| JP | 2007-316538 | 12/2007 |

* cited by examiner

*Primary Examiner* — Clayton E LaBalle
*Assistant Examiner* — Leon W Rhodes, Jr.
(74) *Attorney, Agent, or Firm* — Renner, Otto, Boisselle & Sklar, LLP

(57) ABSTRACT

A control portion obtains a first difference in a movement amount between paper passing period and paper non-passage period of a transfer belt, and determines whether or not a first absolute value thereof is a first threshold value or more. In a case where the first absolute value is the first threshold value or more, a transfer belt unit positional adjustment motor is driven to adjust a first angle with respect to a first direction of a transfer belt unit with respect to a photoreceptor drum. In a case where the first absolute value is less than the first threshold value, a second absolute value of a second difference between a movement amount and a designed value set in advance of the transfer belt is obtained, and whether or not the second absolute value is a second threshold value or more is determined. When the second absolute value is less than the second threshold value, the processing is finished, and when the second absolute value is the second threshold value or more, a second angle with respect to a second direction orthogonal to the first direction of the driving roller with respect to the photoreceptor drum is adjusted so as to be less than the second threshold value by a driving roller positional adjustment motor.

4 Claims, 8 Drawing Sheets

FIG. 7

| EXPERIMENTAL VALUE | | | | |
|---|---|---|---|---|
| DRIVING ROLLER POSITION | | MEASUREMENT VALUE | DIFFERENCE | UN POSITION MOVEMENT CONTROL |
| 0.50 | Paper passing period | 9.5 | 6.5 | Move UN by 0.5 in - direction |
| | Paper non-passage period | 3.0 | | |
| 0.25 | Paper passing period | 4.0 | 2.0 | No movement of UN |
| | Paper non-passage period | 2.0 | | |
| 0.00 | Paper passing period | 1.0 | 0.5 | |
| | Paper non-passage period | 0.5 | | |
| -0.25 | Paper passing period | -1.0 | 1.0 | |
| | Paper non-passage period | -2.0 | | |
| -0.50 | Paper passing period | -4.0 | -3.0 | Move UN by 0.5 in + direction |
| | Paper non-passage period | -1.0 | | |
| -0.75 | Paper passing period | -8.5 | -6.5 | Move UN by 0.75 in + direction |
| | Paper non-passage period | -2.0 | | |

FIG.8

| EXPERIMENTAL VALUE | | | | |
|---|---|---|---|---|
| DRIVING ROLLER POSITION | | MEASUREMENT VALUE | DIFFERENCE | UN POSITION MOVEMENT CONTROL |
| 0.75 | Paper passing period | -9.3 | -0.3 | Move roller by 0.75 in - direction |
| | Paper non-passage period | -9.0 | | |
| 0.25 | Paper passing period | -6.4 | -0.6 | Move roller by 0.25 in - direction |
| | Paper non-passage period | -5.8 | | |
| 0.00 | Paper passing period | -0.3 | -0.3 | No movement of roller |
| | Paper non-passage period | 0.0 | | |
| -0.25 | Paper passing period | 9.8 | 1.4 | |
| | Paper non-passage period | 8.4 | | |
| -0.75 | Paper passing period | 13.4 | 2.2 | Move roller by 0.75 in + direction |
| | Paper non-passage period | 11.2 | | |

IMAGE FORMING APPARATUS

This Nonprovisional application claims priority under 35 U.S.C. §119(a) on Patent Application No. 2010-171780 filed in Japan on 30 Jul. 2010, the entire contents of which are hereby incorporated by reference.

BACKGROUND OF THE INVENTION

1. Field of the Invention

The present invention relates to an image forming apparatus in which a toner image borne on an image bearer is transferred to a sheet by a transfer belt.

2. Description of the Prior Art

A transfer belt of an image forming apparatus serves to transfer a toner image formed on a photoreceptor drum (image bearer) to a sheet. In this case, a toner is attached to an electrostatic latent image formed on the photoreceptor drum to forma toner image, and the transfer belt is charged to a potential opposite to that of the photoreceptor drum. The toner image on the photoreceptor drum is transferred to a sheet which is conveyed by being attracted by the transfer belt.

Meanwhile, in such an image forming apparatus, some problems occur, such as breakage of the transfer belt due to meandering of the belt, deterioration in positional accuracy of an image, degradation in image quality and the like. In order to solve the problems, there are some apparatuses in which a rib is attached to a reverse side of an end portion of the belt, and the rib is brought into contact with an end portion of a roller by which the belt is stretched out, so that meandering of the belt is suppressed.

Furthermore, in Patent Literature 1, a position of an end portion of a transfer belt is detected by a line sensor, and in a case where the transfer belt meanders, with an end of a transfer belt driven roller serving as a fulcrum, the other end is turned so as to correct meandering thereof, and thereafter a shaft of the driven roller is fixed with a screw. After that, a transfer belt unit itself composed of the transfer belt, the roller and the like is turned, a sheet conveyance direction by a registration roller is aligned with a sheet conveyance direction of the transfer belt in which position adjustment of the driven roller is performed, and fixed by a screw.

Furthermore, in Patent Literature 2, a position of an end portion of a transfer belt is detected by a sensor, and in a case where the transfer belt meanders, with an end of a transfer belt driven roller serving as a fulcrum, the other end is automatically turned by an eccentric cam so as to correct the meandering.

Patent Literature 1: Japanese Patent Application Laid-open No. 2005-138986

Patent Literature 2: Japanese Patent Application Laid-open Hei 4 No. 50992

In the case of a method of attaching a rib on the reverse side of the end portion of the transfer belt, the rib may be scraped, and the belt may be broken from a seam of the rib where a front end and a rear end of the rib are opposed to each other, so that lifetime of the belt is shortened. Moreover, a step of attaching the rib is required so that production time increases. In a state where a rib is not used, it has been found out that the lifetime which is twice that of the conventional one is achievable. However, when the rib to be attached to the belt is eliminated, a correction mechanism is required for a case where the belt meanders.

Meandering of the transfer belt is due to not only inclination of the roller stretching out the transfer belt, but also position displacement of the transfer belt unit itself with respect to the photoreceptor. The transfer belt unit is driven in contact with the image bearer, and therefore, force applied to the transfer belt varies between paper passing period and paper non-passage period, so that an angle between the image bearer and the transfer belt unit is displaced in some cases.

Furthermore, in Patent Literature 1, the position adjustment of the transfer belt and the transfer belt unit itself is possible to be performed, however, the position adjustment itself is not automatically performed and it must be performed by a user. Although the position adjustment is simplified, some degree of proficiency is still required.

Moreover, in Patent Literature 2, although the meandering is corrected by a positional change of the roller, it is not automatically controlled including the positional adjustment of the transfer belt unit. Accordingly, it is difficult to say that meandering of the belt is able to be sufficiently prevented.

SUMMARY OF THE INVENTION

It is an object of the present invention to provide an image forming apparatus for not only correcting meandering by a positional change of a roller stretching out a transfer belt, but also suppressing meandering by adjusting a position of a transfer belt unit.

The present invention provides an image forming apparatus which transfers a toner image formed on an image bearer to a sheet via a transfer belt that includes an image bearer, a transfer belt unit which drives a transfer belt stretched out by a plurality of rollers, a transfer belt movement amount measuring portion which measures a movement amount of the transfer belt within a predetermined time between paper passing period and paper non-passage period of a sheet, a transfer belt unit position adjustment portion which adjusts a first angle with respect to a first direction of the transfer belt unit with respect to the image bearer, a roller position adjustment portion which adjusts a second angle with respect to a second direction orthogonal to the first direction of at least one of the rollers with respect to the image bearer, and a control portion which determines to use either the transfer belt unit positional adjustment portion or the roller positional adjustment portion for adjustment in accordance with a first absolute value of a first difference in a measurement movement amount of the transfer belt between paper passing period and paper non-passage period so as to reduce the first difference.

Here, in a case where the first absolute value is a first threshold value or more, the control portion adjusts the first angle by the transfer belt unit positional adjustment portion so that the first absolute value becomes less than the first threshold value.

Furthermore, in a case where the first absolute value is less than the first threshold value, and a second absolute value of a second difference between the measurement movement amount during the paper passing period and a designed movement amount during paper passing period is a second threshold value or more, the control portion adjusts the second angle using the roller position adjustment portion so that the second absolute value becomes less than the second threshold value.

According to the present invention, since determination is made to adjust using either the transfer belt unit position adjustment portion or the roller position adjustment portion according to the absolute value of the difference in the measurement movement amount of the transfer belt between paper passing period and paper non-passage period, it is easy to detect the time when the position adjustment is required, and accordingly, inclination of the transfer belt unit and the roller with respect to the image bearer is able to be adjusted automatically. When the transfer belt unit is inclined with respect to the image bearer, with rotation of the image bearer, the transfer belt has force exerted toward a meandering direction, and such inclination is thus corrected. Moreover, there is also a case where the transfer belt meanders when the roller of the transfer belt unit is inclined with respect to the image bearer, and the meandering is able to be suppressed even in such a case. Further, a meandering prevention rib on a reverse side of an end portion of a transfer belt is able to be eliminated, so that the production time is able to be shortened and the lifetime of the transfer belt is able to be lengthened.

BRIEF DESCRIPTION OF THE DRAWINGS

FIG. 7 is a table of processing details for performing the positional adjustment of the transfer belt unit in the Y direction according to FIG. 6; and FIG. 8 is a table of processing details for performing the positional adjustment of the driving roller in the X direction according to FIG. 6.

DESCRIPTION OF THE PREFERRED EMBODIMENTS

Description will be hereinafter given for embodiments of the present invention with reference to the attached drawings.

Figure 1:
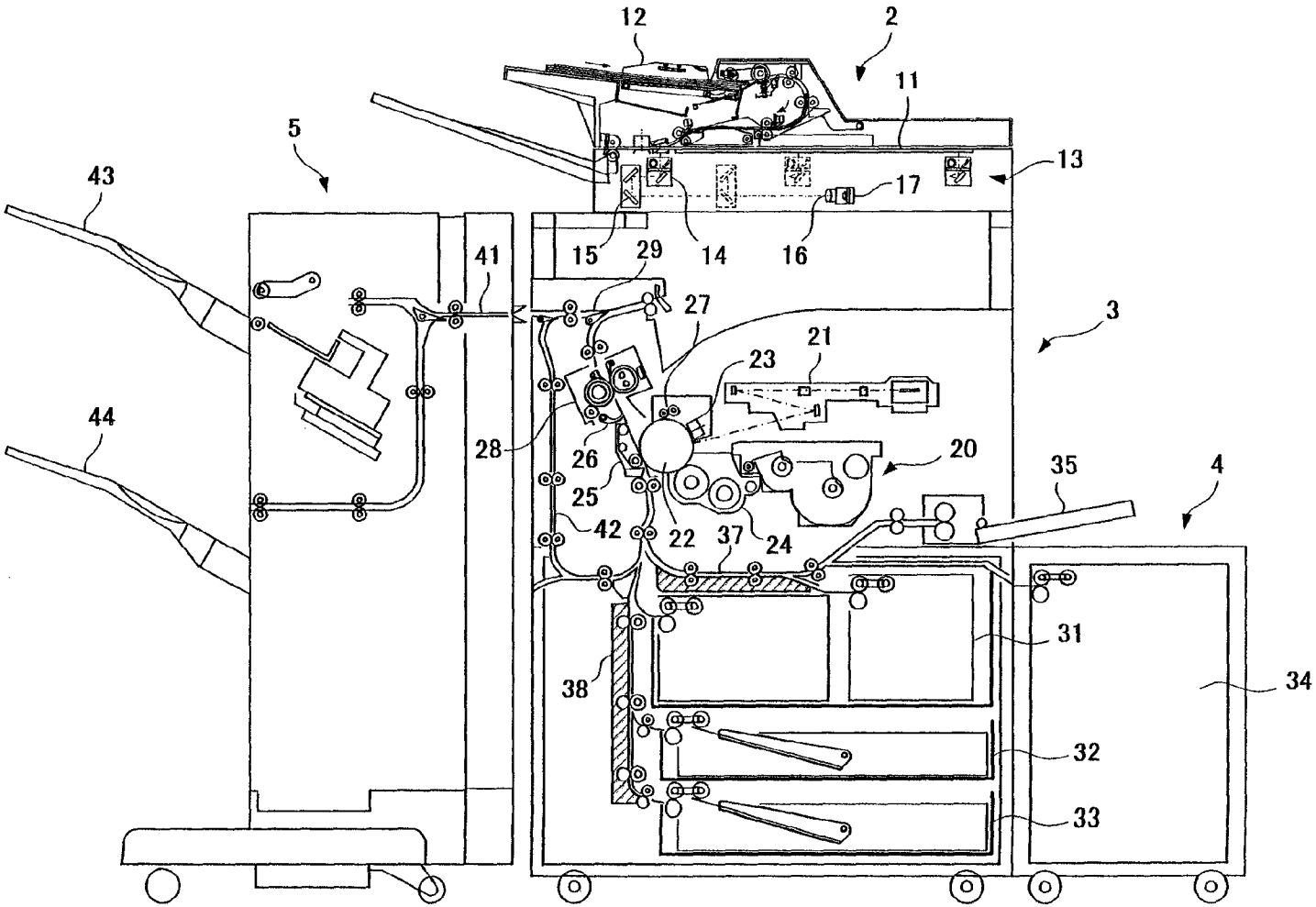
FIG. 1 is a cross-sectional view showing an image forming apparatus that applies an embodiment of the present invention.

FIG. 1 is a cross-sectional view showing an image forming apparatus that applies an embodiment of the present invention. An image reading portion 2 includes a document platen 11 made of transparent glass, a reversing automatic document feeder (RADF) 12 for automatically supplying a document onto the document platen 11, and a document image reading unit for scanning and reading a document image placed on the document platen 11, that is, a scanner unit 13.

The RADF 12 is a conventional device for setting a plurality of sheets of a document on a predetermined document tray at one time to automatically feed the set documents sheet by sheet onto the document platen 11 of the scanner unit 13. Furthermore, the RADF 12 is comprised of a conveyance path for a single-sided document, a conveyance path for a two-sided document, conveyance path switching means and the like so as to read a single side or two sides of a document by the scanner unit 13 according to a selection of a user.

The scanner unit 13 includes a first scan unit 14 equipped with a lamp reflector assembly for exposing a document surface to light and a first reflective mirror for guiding to a photoelectric conversion element (CCD) 17 that converts a reflected image of light from the document into an electric image signal, a second scan unit 15 equipped with a second reflective mirror and a third reflective mirror, and an optical lens body 16 for forming the reflected image of light on the CCD 17.

The first scan unit 14 runs at a constant speed V from left to right along the document platen 11, and the second scan unit 15 is subjected to scanning control so as to run at a V/2 speed in the same direction.

Whereby, at the image reading portion 2, a document image is read by, while sequentially placing a document to be read on the document platen 11 with operations of the RADF 12 correlated to the scanner unit 13, moving the scanner unit 13 along a lower face of the document platen 11 to sequentially form a document image placed on the document platen 11 by the CCD 17 for each line.

Image data obtained by reading the document image with the scanner unit 13 is once registered in a memory after various processing is applied, and the image data is output from the memory to an image forming portion 3 in response to an output instruction to be reproduced on a photoreceptor drum (image bearer) 22 as a visible image, thereafter the image is transferred onto a sheet to form a toner image.

This image forming portion 3 is provided with a laser scanning unit (LSU) 21 and an electrophotographic process portion 20 for forming an image.

The laser scanning unit 21 includes a semiconductor laser that emits a laser beam corresponding to image data which is read from a memory or image data which is transferred from an external device such as a personal computer, a polygon mirror that deflects a laser beam at an equiangular speed and an f-θ lens that corrects so that the laser beam deflected at the equiangular speed scans at a uniform speed on the photoreceptor drum 22 of the electrophotographic process portion 20.

The electrophotographic process portion 20 is configured that, according to a known aspect, a charging device 23, a developing device 24, a transfer device 25, a peeling device 26, a cleaning device 27 and a charge erasing device are arranged around the photoreceptor drum 22, and further a fixing device 28 is arranged on a downstream side of the photoreceptor drum 22.

A paper feeding portion 4 includes a first cassette 31 to a third cassette 33, a manual feeding tray 35 and further a fifth tray in a large volume cassette 34 as an optional extra.

The first cassette 31 is a tandem tray that contains a first tray and a second tray, and capable of concurrently drawing both trays from the apparatus body. The second cassette tray 32 and the third cassette tray 33 contain a third tray and a fourth tray, respectively. In other words, four trays are contained in three cassettes (31 to 33). The large volume cassette 34 is a large volume tray, and thus capable of containing a most frequently used sheet, for example, an A4-size standard sheet.

Paper feeding conveyance portions 37 and 38 are provided with a paper feeding roller, a feed roller and a registration roller in order to convey a sheet from the paper feeding portion 4 to a transfer position between the photoreceptor drum 22 and the transfer device 25.

In four trays in the first cassette 31 to the third cassette 33 and the large volume cassette 34 in the paper feeding portion 4, sheets are layered for each size to be contained, and when a user selects a cassette or a tray containing desired sized sheets, the sheets are fed sheet by sheet from the top of a batch of sheets in the tray, and sequentially conveyed toward the electrophotographic process portion 20 through conveyance paths of the paper feeding conveyance portions 37 and 38.

In the laser scanning unit 21 and the electrophotographic process portion 20, image data read from a memory is input to the laser scanning unit 21.

The laser scanning unit 21 scans the photoreceptor drum 22 in a direction to which an axis of the drum extends (axial direction) with a laser beam based on the image data, thereby forming an electrostatic latent image corresponding to the image data on the surface of the photoreceptor drum 22. The electrostatic latent image is visualized by a toner of the developing device 24, and the toner image is electrostatically transferred by the transfer device 25 onto the surface of a sheet transferred from the paper feeding portion 4 to be fixed by the fixing device 28.

A paper discharge path 29 is provided on a downstream side in a paper conveyance direction of the fixing device 28, and the paper discharge path 29 is branched into a paper discharge conveyance path 41 of a paper discharge portion 5 and a conveyance portion 42 for duplex copying.

A sheet on which an image is formed in this manner is sent from the fixing device 28 to the paper discharge portion 5, or selectively conveyed to the conveyance portion 42 for duplex copying.

The sheet sent to the paper discharge portion 5 is subjected to predetermined processing such as sort processing or staple processing as necessary, and stacked on a first discharge tray 43 or a second discharge tray 44.

Further, the sheet sent to the conveyance portion 42 for duplex copying is reversed here to be conveyed to the electrophotographic process portion 20 again, and an image is formed on a reverse side of the sheet to be discharged after fixation.

FIG. 2*a* and FIG. 2*b* are schematic views showing the transfer device 25. FIG. 2*a* is an external view, and FIG. 2*b* is a cross-sectional view. Description will be given below for a structure of a transfer unit and an operation outline thereof.

The transfer device 25 is comprised of a transfer belt unit 30 and other parts.

The transfer belt unit 30 includes a transfer belt 51, a driving roller 52, a driven roller 53, a transfer roller 59 and support frames 78 and 79.

The transfer belt 51 arranged on a lower side of the photoreceptor drum 22 is stretched out between the driving roller 52 and the driven roller 53 to be driven in a conveyance direction D1 indicated by an arrow.

Figure 2:
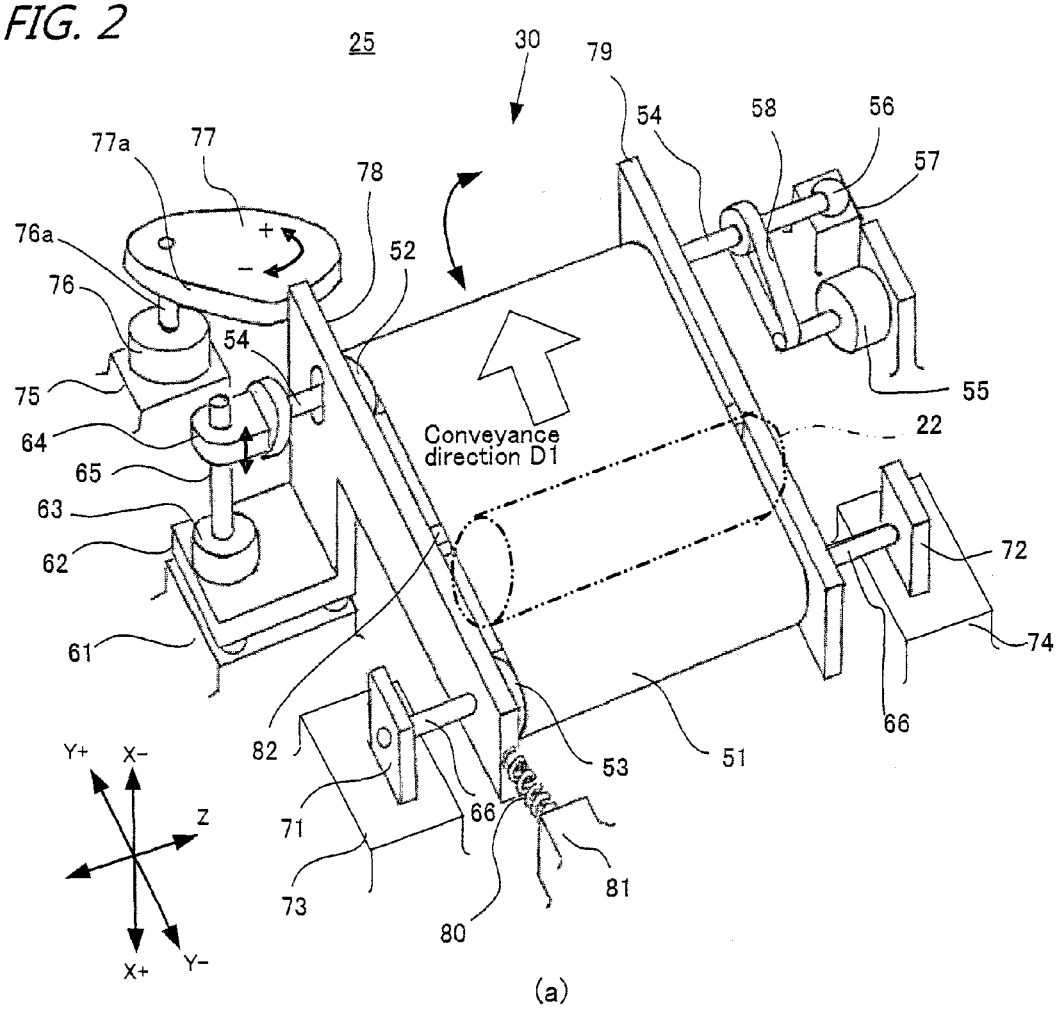
FIG. 2 is a schematic view showing a transfer belt unit.
Figure 2:
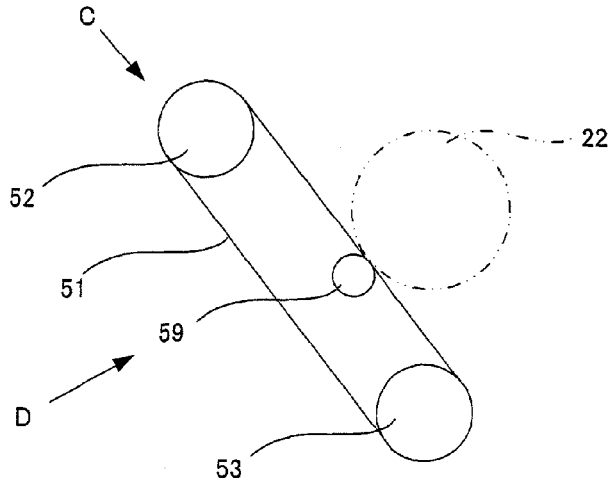

The driving roller 52 rotates with rotary drive imparted by a transfer belt driving motor 55 to a one end side of a driving roller shaft 54. FIG. 2 shows that rotary drive force by the transfer belt driving motor 55 is transmitted to the driving roller shaft 54 by a belt 58, however, it may be configured that rotary drive force is conveyed by a gear.

On a reverse side of the transfer belt 51 in contact with the photoreceptor drum 22, the transfer roller 59 imparting a potential opposite to that of the photoreceptor drum 22 to the transfer belt 51 is provided. The transfer roller 59 transfers a toner image formed on the photoreceptor drum 22 to a sheet on the transfer belt 51.

The transfer belt 51 moves in direct contact with the photoreceptor drum 22 during paper non-passage period, but moves in contact with the photoreceptor drum 22 through a sheet during paper passing period. Therefore, during paper passing period, greater pressing force is exerted on the transfer belt 51 from the photoreceptor drum 22 by the thickness of the sheet in view of a relation of which a transfer potential is imparted to the sheet. Accordingly, when pressing force is uneven between the photoreceptor drum 22 and the transfer belt unit 30 (transfer belt 51) over the width of the transfer belt 51, the transfer belt 51 has force exerted toward a meandering direction by rotation of the photoreceptor drum 22.

In other words, even though an assembly of the transfer belt unit 30 is correct with respect to the image forming portion 3, in a case where there is even slight displacement of force applied to the transfer belt 51 over the width of the transfer belt 51 due to contact with the photoreceptor drum 22 during paper passing period or during paper non-passage period, the transfer belt unit 30 is inclined to a side having greater pressing force from the photoreceptor drum 22. Thus, in a case where the transfer belt unit 30 continues to be driven in an inclined state with respect to an axial direction of the photoreceptor drum 22, the transfer belt 51 comes to meander.

On the other hand, even in the event of even pressing force between the photoreceptor drum 22 and the transfer belt unit 30 over the width of the transfer belt unit 30, when an angle between the conveyance direction D1 of the transfer belt 51 and an axial direction of the photoreceptor drum 22 is displaced from a right angle, the transfer belt 51 comes to meander. In other words, in a case where the driving roller 52 is not parallel to the photoreceptor drum 22, the transfer belt 51 comes to meander.

Accordingly, the present embodiment has a structure capable of adjusting positions of the transfer belt unit and a roller for preventing meandering, which is described in detail below.

An one end side of the driving roller shaft 54 is supported by a fulcrum bearing 56 so as to rotate freely. The fulcrum bearing 56 is supported by a support base 57 fixed on a body side of the image forming portion 3 so as to turn freely so that it is possible to turn the driving roller shaft 54 in any directions.

On the other hand, the other end side of the driving roller shaft 54 is supported by a bearing 64 so as to rotate freely.

The bearing 64 is connected to a motor shaft 65 of a driving roller position adjustment motor 63 so as to be movable along the motor shaft 65.

The driving roller positional adjustment motor 63 is fixed to an attaching base 62 placed on a support base 61 on the side of the image forming portion 3 so as to be movable.

Further, a female thread is formed in the bearing 64 and a male thread is formed in the motor shaft 65, and the male thread of the motor shaft 65 is inserted into the bearing 64 in which the female thread is formed so that the bearing 64 is connected to the motor shaft 65.

Figure 3:
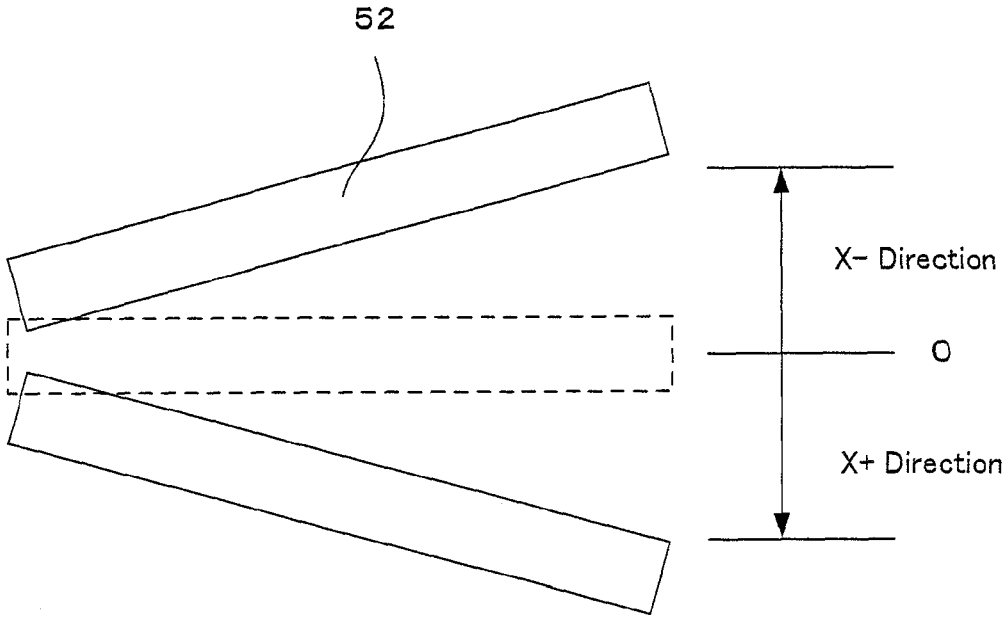
FIG. 3 is a view showing positional adjustment of a driving roller in an X direction.

Therefore, rotation of the driving roller positional adjustment motor 63 makes it possible for the driving roller 52 to move the other end side of the driving roller shaft 54 in an X-axis direction (X+ direction, X− direction: FIG. 2*a*) with the fulcrum bearing 56 serving as a fulcrum. Such an aspect is shown in FIG. 3. FIG. 3 is a view in which the driving roller shaft 54 is viewed from a C direction of FIG. 2*b*.

Note that, the X-axis direction, a Y-axis direction and a Z-axis direction of FIG. 2*a* are orthogonal to each other, and an angle of which each direction forms is a right angle.

An axial direction of the photoreceptor drum 22 is the Z-axis direction.

The conveyance direction D1 of the transfer belt 51 orthogonal to the axial direction of the photoreceptor drum 22 is the Y-axis direction. In other words, the conveyance direction D1 of the transfer belt 51 in a case where both axial directions of the photoreceptor drum 22 and the driving roller 52 are parallel to each other is the Y-axis direction.

A direction orthogonal to both directions of the axial direction of the photoreceptor drum 22 and the conveyance direction D1 of the transfer belt 51 orthogonal to the axial direction of the photoreceptor drum 22 is the X-axis direction. In other words, a radial direction of the photoreceptor drum 22 orthogonal to the surface of the transfer belt parallel to the axial direction of the photoreceptor drum 22 is the X-axis direction. An axial direction of the motor shaft 65 is the X-axis direction.

In the bearing 64, a part supporting the driving roller shaft 54 so as to rotate freely and a part provided with a female thread that enables an end portion of the roller shaft 54 to move in the X-axis direction are integrally formed.

The above-described configuration makes it possible for the driving roller 52 to swing in the X-axis direction (X+, X−) of FIG. 2 with the fulcrum bearing 56 serving as a fulcrum.

Both shaft ends of a driven roller shaft 66 are supported by bearings 71 and 72 so as to rotate freely, and the bearings 71 and 72 are placed on the support bases 73 and 74 on the image forming portion 3 side so as to be able to slide.

A spring 80 is provided at an end portion of the support frame 78 close to the bearing 71, extending to a support base 81 on the image forming portion 3 side.

The spring 80 is provided so as to urge the support frame 78 to a cam 77 described below all the time.

On the other hand, with respect to the Y-axis direction (conveyance direction D1) of the support frame 78, a support base 75 on the image forming portion 3 side is provided on the side opposite to the spring 80. At the support base 75, a transfer belt unit position adjustment motor 76 is fixed.

A shaft center of a motor shaft 76*a* of the transfer belt unit position adjustment motor 76 extends in the X-axis direction, and the cam 77 formed as a disc is arranged in the motor shaft 76*a*.

The cam 77 is an eccentric cam whose length from the motor shaft 76*a* to a periphery 77*a* (eccentric peripheral face) is uneven in a plane including a Y-axis and a Z-axis, and an eccentricity amount of the cam 77 is arbitrarily settable based on an adjustment amount and an adjustment direction described below.

An attaching position of the support base 75 or the transfer belt unit positional adjustment motor 76 is set to a position where the eccentric peripheral face 77*a* of the cam 77 is in sliding contact with the support frame 78.

The above-described configuration allows the eccentric cam 77 for transfer belt unit positional adjustment to rotate, so that the eccentric peripheral face 77*a* of the eccentric cam 77 comes in sliding contact with the support frame 78 supporting the transfer belt 51, and it is possible to move the support frame 78 of the transfer belt unit 30 urged by the spring 80 in the Y-axis direction (Y+, Y−) with the fulcrum bearing 56 serving as a fulcrum.

Figure 4:
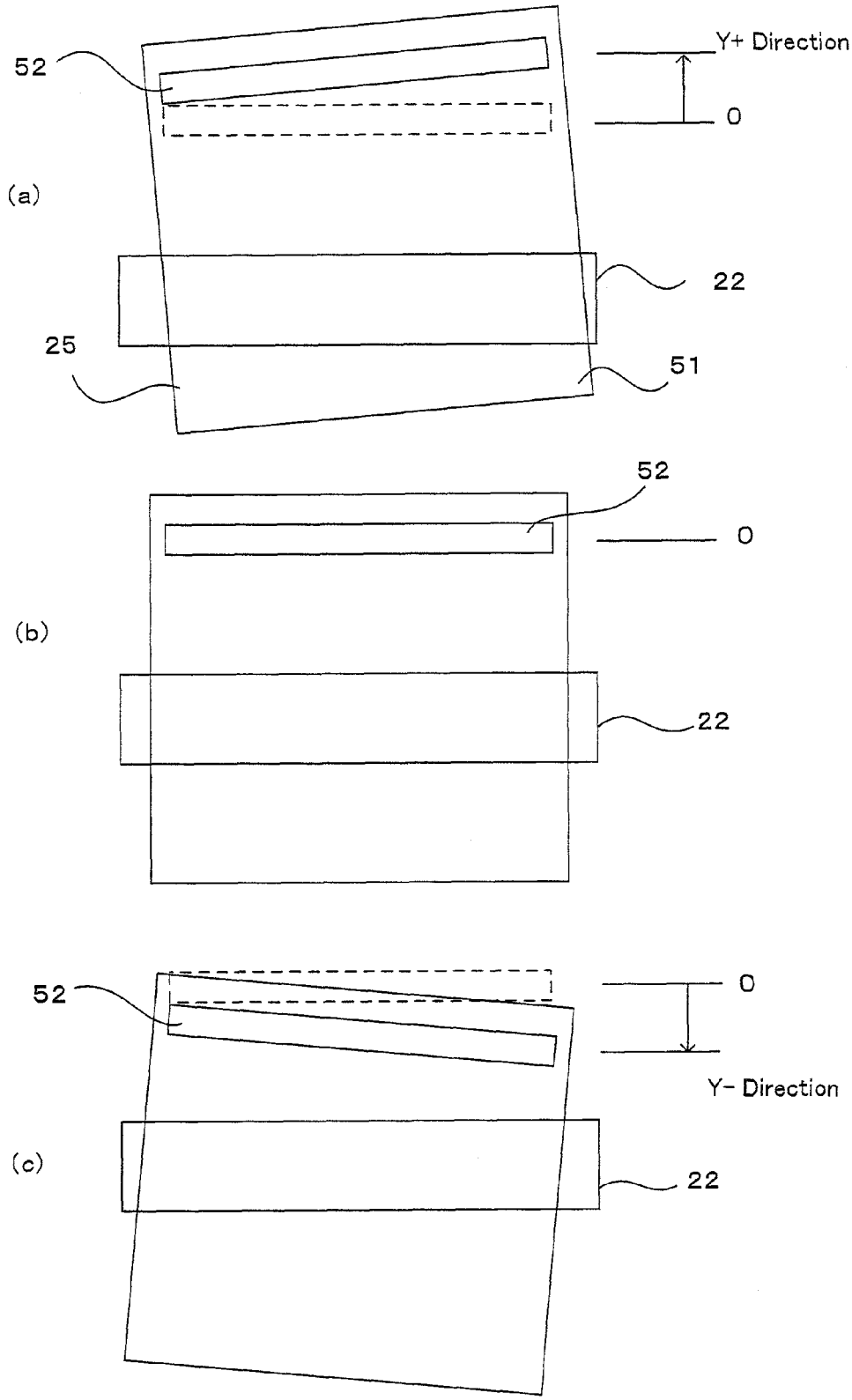
FIG. 4*a* to FIG. 4*c* are views showing positional adjustment of the transfer belt unit in a Y direction.

FIG. 4 is a view showing positional adjustment concerning the Y-axis direction of the transfer belt unit 30. This is a view in which the transfer belt unit 30 and the photoreceptor drum 22 are viewed from the D direction of FIG. 2*b*. FIG. 4*a* is a view showing a state of which the transfer belt unit 30 is displaced in the Y+ direction in reference to the photoreceptor drum 22, FIG. 4*b* is a view showing a state of which movement of the transfer belt unit 30 is adjusted on the basis of the photoreceptor drum 22, and FIG. 4*c* is a view showing a state of which the transfer belt unit 30 is displaced in the Y− direction on the basis of the photoreceptor drum 22.

When the eccentric cam 77 is turned to a + direction of FIG. 2 by the transfer belt unit positional adjustment motor 76, a shape of the eccentric cam 77 allows the support frame 78 urged by the spring 80 to, for example, move in the Y− direction. Therefore, as shown in FIG. 4*a*, the transfer belt unit 30 displaced in the Y+ direction in reference to the photoreceptor drum 22 is able to move in the Y− direction with the fulcrum bearing 56 serving as a fulcrum by turning the eccentric cam 77 to the + direction of FIG. 2. As shown in FIG. 4*b*, this makes it possible to adjust so that an axial direction of the driving roller 52 of the transfer belt unit 30 is parallel (displacement, inclination=0) to an axial direction of the photoreceptor drum 22.

When the eccentric cam 77 is turned to a − direction of FIG. 2 by the transfer belt unit positional adjustment motor 76, a shape of the eccentric cam 77 allows the support frame 78 urged by the spring 80 to, for example, move in the Y+ direction. Therefore, as shown in FIG. 4*c*, the transfer belt unit 30 displaced in the Y− direction in reference to the photoreceptor drum 22 is able to move in the Y+ direction with the fulcrum bearing 56 serving as a fulcrum by turning the eccentric cam 77 to the − direction of FIG. 2. As shown in FIG. 4*b*, this makes it possible to perform positional adjustment so that an axial direction of the driving roller 52 of the transfer belt unit 30 is parallel (displacement, inclination=0) to the axial direction of the photoreceptor drum 22.

Here, as shown in FIG. 2, the transfer belt driving motor 55 and the transfer belt unit positional adjustment motor 76 are fixed on the apparatus body side (image forming portion 3). Further, the support bases 57, 61, 73, 74 and 75 are also fixed to the apparatus body.

For the driving roller positional adjustment motor 63 and the transfer belt unit positional adjustment motor 76, a step motor is used to control the rotation by the number of steps.

A reverse side of a belt of the transfer belt 51 is marked up, and a belt speed is measured by a transfer belt movement amount detection sensor 82 (FIG. 2*a*) formed of a light-emitting/receiving sensor to obtain a movement amount (movement distance) from speed.

Figure 5:
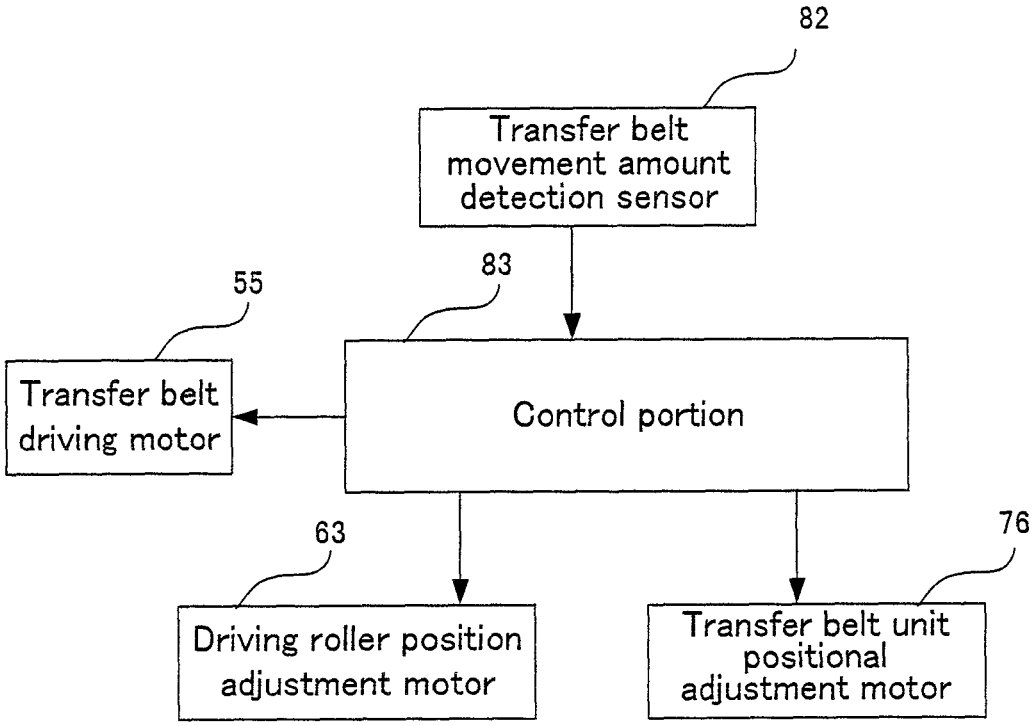
FIG. 5 is a block diagram of a configuration concerning meandering adjustment processing of a transfer belt.

FIG. 5 is a block diagram of a configuration with respect to meandering adjustment processing of the transfer belt 51.

The control portion 83 performs transferring while controlling the transfer belt driving motor 55, and simultaneously controls the driving roller position adjustment motor 63 and the transfer belt unit positional adjustment motor 76 based on the movement amount by the measurement with the transfer belt movement amount detection sensor 82 so as to perform meandering adjustment of the transfer belt 51.

Figure 6:
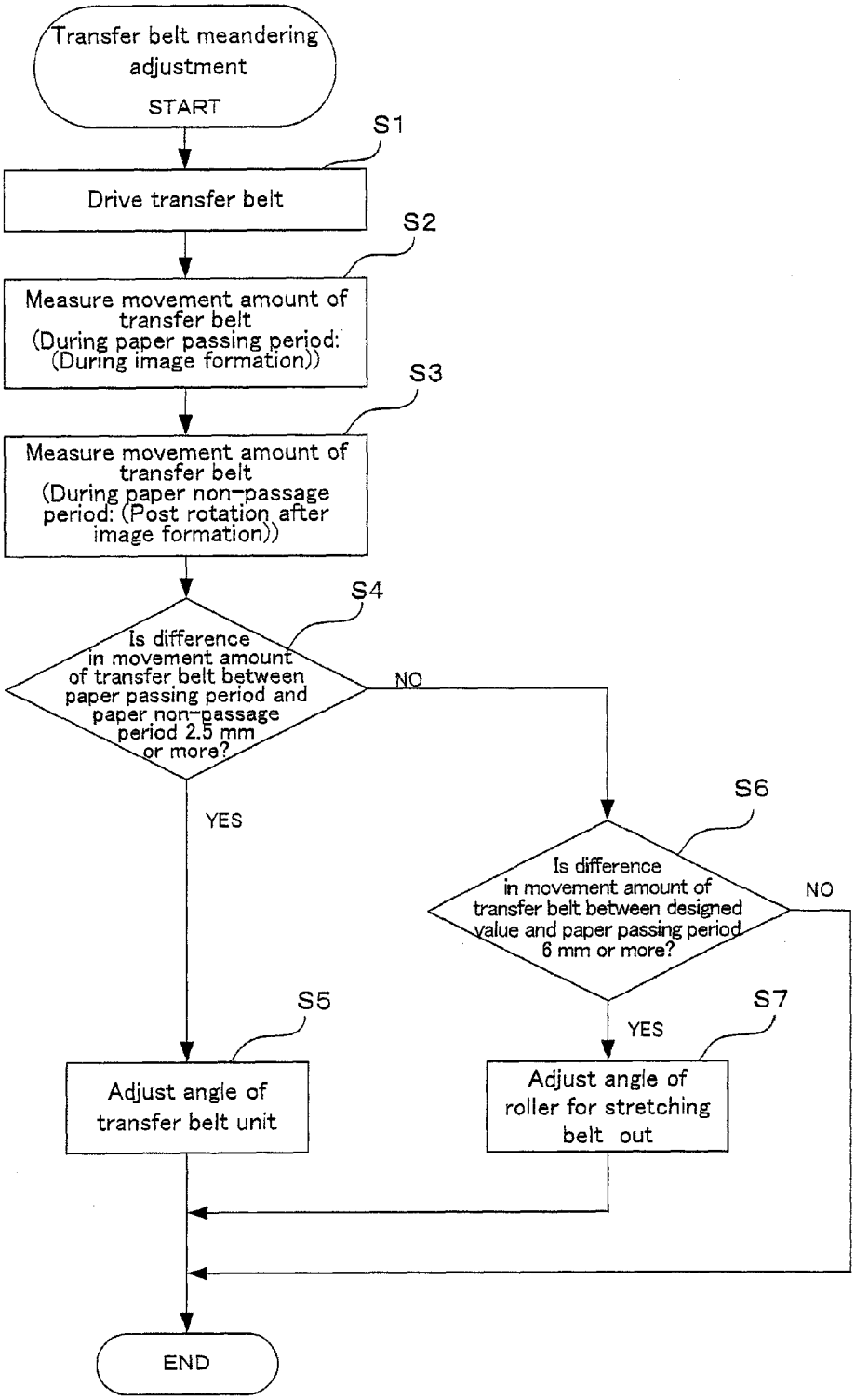
FIG. 6 is a flowchart showing the meandering adjustment processing of the transfer belt.

FIG. 6 is a flowchart showing the meandering adjustment processing of the transfer belt 51.

The control portion 83 drives the transfer belt driving motor 55 to drive the transfer belt 51 (step S1).

The control portion 83 obtains a movement amount of the transfer belt 51 during paper passing period (within a predetermined time) by a measurement value from the transfer belt movement amount detection sensor 82 (step S2).

The control portion 83 then obtains a movement amount of the transfer belt 51 during paper non-passage period by a measurement value from the transfer belt movement amount detection sensor 82 (step S3).

The control portion 83 obtains a difference in the movement amount (first difference) between paper passing period and paper non-passage period of the transfer belt 51 to determine whether or not an absolute value of the first difference (first absolute value) is a first threshold value or more (step S4). The first threshold value, for example, is 2.5 mm, which is set in advance.

In a case where the first absolute value is the first threshold value or more, the process proceeds to step S5, and the control portion 83 drives the transfer belt unit positional adjustment motor 76 to adjust a first angle in a plane including the Y-axis and the Z-axis of the transfer belt unit 30 (driving roller 52) with respect to the photoreceptor drum 22 so as to be less than the first threshold value (step S5). That is, the first angle is an angle formed by an axial direction of the driving roller 52 with respect to an axial direction of the photoreceptor drum 22 with respect to a Y direction (transfer belt surface direction).

At this time, a direction and an amount of rotation to be performed for the cam 77 for transfer belt unit positional adjustment is obtained in advance to be stored in, for example, a look-up table and the like, so as to be obtained from the difference in the movement amount.

At step S4, when the first absolute value is less than the first threshold value, the process proceeds to step S6, and an absolute value (second absolute value) of a difference (second difference) between a measured movement amount and a designed value set in advance of the transfer belt 51 (designed movement amount within a predetermined time obtained from a designed speed of the transfer belt 51) is obtained to determine whether or not the second absolute value is the second threshold value or more is determined. Here, the second threshold value is 6 mm, for example. The value is also set in advance.

When the second absolute value is less than the second threshold value, the processing is finished.

On the other hand, when the second absolute value is the second threshold value or more, a second angle in a plane including the X-axis and the Y-axis of the driving roller 52 with respect to the photoreceptor drum 22 is adjusted so as to be less than the second threshold value by the driving roller positional adjustment motor 63. That is, the second angle is an angle formed by an axial direction of the driving roller 52 with respect to an axial direction of the photoreceptor drum 22 with respect to an X direction (a direction orthogonal to both the axial direction of the photoreceptor drum 22 and the conveyance direction D1).

An amount of movement to be performed for one side of the driving roller 52 is obtained in advance to be stored in, for example, a look-up table and the like so as to be obtained from the difference in the movement amount.

In this manner, the adjustment control is performed based on the difference (first difference, second difference) in the measurement movement amount between paper passing period and paper non-passage period, therefore the control portion 83 is able to judge the timing when the positional adjustment for the transfer belt unit 30 or the driving roller 52 is required easily, and also, appropriately, so as to be able to automatically perform positional adjustment for meandering prevention using either the transfer belt unit positional adjustment motor 76 or the driving roller positional adjustment motor 63. Further, the meandering prevention rib on the reverse side of the end portion of the transfer belt 51 is able to be eliminated and the production time is able to be shortened and the lifetime of the transfer belt is able to be lengthened.

<Experimental Result>

Here, in a case where the position of the driving roller 52 is the position shown in FIG. 7 and FIG. 8, experiments of measuring the movement distance of the transfer belt 51 were performed. Main data of components used in the experiments is as follows.

Main Data of Components

1) Transfer Belt Physical Property

NBR-type rubber belt (thickness=400-700 μm)

No reverse side processing, surface with fluoro-resin-type coating

2) Transfer Roller Physical Property

Transfer roller diameter: ϕ 14 mm

EPDM-type foamed rubber roller (hardness=about 40 JIS-C)

3) Transfer belt diameter: ϕ 60 mm

4) Driven roller diameter: ϕ 17 mm

5) Process speed: 400 mm/s (rotation speed of transfer belt)

6) Photoreceptor: OPC

FIG. 7 is a table of processing details for performing the positional adjustment of the transfer belt unit 30 according to FIG. 6. FIG. 8 is a table of processing details for performing the positional adjustment of the driving roller 52 according to FIG. 6. Note that, "UN" in FIG. 7 shows the transfer belt unit 30 and "roller" in FIG. 8 shows the driving roller 52.

The first and second threshold values for deciding whether to change the position of the transfer belt unit 30 and the driving roller 52 may be decided as appropriate because of being affected by the size, type of material and the like of the transfer belt 51, the photoreceptor drum 22 and the like. Here, a plurality of first threshold values (differences) to perform transfer belt unit adjustment and a plurality of second threshold values (differences) to perform driving roller adjustment are decided as shown in the tables of FIG. 7 and FIG. 8.

As the result of the experiments in the tables, it is found that when determination is made as to either the position of the transfer belt unit (the first angle with respect to the photoreceptor drum) is adjusted or the second angle of the driving roller stretching out the transfer belt is adjusted from the difference in the transfer belt movement amount between paper passing period and paper non-passage period and the difference of the measured value of the movement amount of the transfer belt with respect to the designed value thereof, and control to adjust the position of the unit or the roller is performed, the meandering is able to be suppressed.

Note that, in the above description, the second angle of the driving roller 52 is adjusted by the driving roller positional adjustment motor 63, but not limited thereto, and a similar effect is able to be obtained even in a case of adjusting the second angle of the driven roller 53 by the roller positional adjustment motor, or even in a case of adjusting both the second angles of the driving roller 52 and the driven roller 53 by the roller positional adjustment motor.

What is claimed is:

1. An image forming apparatus which transfers a toner image formed on an image bearer to a sheet via a transfer belt comprising:

an image bearer;

a transfer belt unit which drives a transfer belt stretched out by a plurality of rollers;

a transfer belt movement amount measuring portion which measures a movement amount of the transfer belt within a predetermined time between paper passing period and paper non-passage period of a sheet;

a transfer belt unit position adjustment portion which adjusts a first angle with respect to a first direction of the transfer belt unit with respect to the image bearer;

a roller position adjustment portion which adjusts a second angle with respect to a second direction orthogonal to the first direction of at least one of the rollers with respect to the image bearer; and a control portion which determines to use either the transfer belt unit positional adjustment portion or the roller positional adjustment portion for adjustment in accordance with a first absolute value of a first difference in a measurement movement amount of the transfer belt between paper passing period and paper non-passage period so as to reduce the first difference.

2. The image forming apparatus according to claim 1, wherein in a case where the first absolute value is a first threshold value or more, the control portion adjusts the first angle by the transfer belt unit positional adjustment portion so that the first absolute value becomes less than the first threshold value.

3. The image forming apparatus according to claim 1, wherein in a case where the first absolute value is less than the first threshold value, and a second absolute value of a second difference between the measurement movement amount during the paper passing period and a designed movement amount during paper passing period is a second threshold value or more, the control portion adjusts the second angle using the roller position adjustment portion so that the second absolute value becomes less than the second threshold value.

4. The image forming apparatus according to claim 2, wherein in a case where the first absolute value is less than the first threshold value, and a second absolute value of a second difference between the measurement movement amount during the paper passing period and a designed movement amount during paper passing period is a second threshold value or more, the control portion adjusts the second angle using the roller position adjustment portion so that the second absolute value becomes less than the second threshold value.

* * * * *